US009844115B2

(12) United States Patent
Beck et al.

(10) Patent No.: US 9,844,115 B2
(45) Date of Patent: Dec. 12, 2017

(54) SYSTEMS AND METHODS FOR OPTIMIZING POWER AND CONTROL OF A MULTICOLORED LIGHTING SYSTEM

(71) Applicant: Lighting Science Group Corporation, Cocoa Beach, FL (US)

(72) Inventors: John Beck, Satellite Beach, FL (US); Julia Irvin, Melbourne, FL (US); Mark Boomgaarden, Satellite Beach, FL (US)

(73) Assignee: Lighting Science Group Corporation, Cocoa Beach, FL (US)

( * ) Notice: Subject to any disclaimer, the term of this patent is extended or adjusted under 35 U.S.C. 154(b) by 0 days.

(21) Appl. No.: 15/210,713

(22) Filed: Jul. 14, 2016

(65) Prior Publication Data

US 2017/0019973 A1 Jan. 19, 2017

Related U.S. Application Data

(60) Provisional application No. 62/192,380, filed on Jul. 14, 2015.

(51) Int. Cl.

| | |
|---|---|
| ***H05B 37/00*** | (2006.01) |
| ***H05B 33/08*** | (2006.01) |
| ***F21K 9/232*** | (2016.01) |
| *F21V 3/02* | (2006.01) |
| *F21Y 115/10* | (2016.01) |

(Continued)

(52) U.S. Cl.

CPC ..... *H05B 33/0863* (2013.01); *F21K 9/232* (2016.08); *H05B 33/0809* (2013.01); *H05B 33/0818* (2013.01); *H05B 33/0821* (2013.01); *H05B 33/0845* (2013.01); *H05B 33/0857* (2013.01); *F21S 2/00* (2013.01); *F21V 3/02* (2013.01); *F21Y 2113/13* (2016.08); *F21Y 2115/10* (2016.08)

(58) Field of Classification Search

CPC ..... H05B 33/0809; H05B 33/0818; H05B 33/0821; H05B 33/0845; H05B 33/0857

USPC ..... 315/185 R, 186, 192

See application file for complete search history.

(56) References Cited

U.S. PATENT DOCUMENTS

| | | | | |
|---|---|---|---|---|
| 2010/0066258 A1* | 3/2010 | Yasuda | ..... | H05B 33/0803 315/186 |
| 2012/0119662 A1* | 5/2012 | Radermacher | ..... | H05B 33/0851 315/158 |

(Continued)

*Primary Examiner* — Tung X Le

(74) *Attorney, Agent, or Firm* — Mark Malek; Stephen Bullock; Widerman Malek, PL

(57) ABSTRACT

Embodiments of the present invention are related to a lighting system comprising a control unit that manages a lighting device with an LED board within an optical chamber. The LED board includes a first string of LEDs and a second string of LEDs. The control unit and the LED board are configured to electrically couple to first and second wires. The first string of LEDs and the second string of LEDs are configured to emit light having different spectral power distributions within the visible spectrum. The first string of LEDs is oriented in an electrically opposite direction than the second string of LEDs. The control unit comprises a switch configured to direct current between the first wire and second wire. The wire to which current is directed is designated active. The designated active wire activates one of the first string of LEDs and second string of LEDs.

18 Claims, 3 Drawing Sheets

(51) Int. Cl.
*F21Y 113/13* (2016.01)
*F21S 2/00* (2016.01)

(56) References Cited

U.S. PATENT DOCUMENTS

2013/0200796 A1* 8/2013 Song ..... F21V 23/002
315/113
2014/0070710 A1* 3/2014 Harris ..... H05B 33/0809
315/185 R
2015/0366017 A1* 12/2015 Xu ..... G09G 3/34
315/192
2016/0366746 A1* 12/2016 van de Ven ..... F21V 29/74

* cited by examiner

SYSTEMS AND METHODS FOR OPTIMIZING POWER AND CONTROL OF A MULTICOLORED LIGHTING SYSTEM

RELATED APPLICATIONS

This application claims the benefit under 35 U.S.C. §119 (e) of U.S. Provisional Patent Application Ser. No. 62/192,380 titled Systems and Methods of Lighting and Control the entire contents of which are incorporated herein by reference.

FIELD OF THE INVENTION

The present invention relates to systems and methods for optimizing power and control of a multicolored lighting system.

BACKGROUND

Standard connected lighting as depicted in FIG. 1 and found in the prior art, includes a plurality of bulbs 112 with two power supply lines connected thereto. A first power supply line, defined as an active line 103 provides a forward biasing electrical current in a direction toward the bulb 112. A second power supply line, defined as a neutral line 104 accommodates little to no current directed away from the bulb 112. Customary light emitting diode (LED) technology involves using individual bulbs 112 that act as housing for an antenna 114, a radio 115, a power supply 101, and a board containing LEDs defined as an LED Board 102. An LED consists of semiconducting material doped with impurities to create a p-n junction. The diode within the LED allows current to flow easily from the p-side, or anode, to the n-side, or cathode. However, current does not flow easily in the reverse direction. When forward biasing current reaches a threshold voltage, the LED emits light. In a connected lighting system, a series of LED bulbs are connected using the same active line 103 and neutral line 104 whereby the active line provides current with sufficient voltage to illuminate the LEDs on each respective bulb.

Operating connected lighting in this manner creates inefficiency. More specifically, since the power supply 101 regulates the current and electrical communication with the individual bulbs 112, it accumulates much of the wear on the bulb. Indeed, it is known in the art that power supply failure is one of the most common modes of LED bulb failure. Therefore, when the power supply 101 on the bulb 112 is no longer operable, the entire bulb 112 must be replaced. This is true for the antennae 114 and radio 115 as well. When these components become damaged over time, the entire bulb 112 must be replaced.

Another inefficiency found in modern LED connected lighting technology is that delivered current only operates one LED string within each bulb 112. This in turn only emits one color associated with that particular LED string. Therefore, should a user desire differently colored light, the entire bulb 112 must be replaced.

This background information is provided to reveal information believed by the applicant to be of possible relevance to the present invention. No admission is necessarily intended, nor should be construed, that any of the preceding information constitutes prior art against the present invention.

SUMMARY OF THE INVENTION

With the above in mind, embodiments of the present invention are related to a lighting system comprising a control unit and a lighting device. The lighting device may include an LED board within an optical chamber. The LED board may include a first string of LEDs and a second string of LEDs. The control unit and the LED board may be configured to electrically couple to first and second wires. The first string of LEDs and the second string of LEDs may be configured to emit light having different spectral power distributions within the visible spectrum. The first string of LEDs may be oriented in an electrically opposite direction than the second string of LEDs. The control unit comprises a switch configured to direct current between the first wire and second wire. The wire to which current is directed may be designated active. The designated active wire may activate one of the first string of LEDs and second string of LEDs.

The lighting system may include the first string of LEDs configured to emit light having a first color and the second string of LEDs configured to emit light having a second color. The first and second strings of LEDs may be alternately activated to emit light having a perceived third color defined as a perceived combined light. The alternate activation of the first and second strings of LEDs may be faster than can be detected by the human eye and may create a perceived third color different from the first color and the second color.

The control unit may include a timer configured to communicate a time of day. The first color, the second color, or third perceived color may be changed based on the time of day that is communicated by the timer. The control unit may further be operable to alternate the designated active wire between the first wire and second wire within a range from every 16 milliseconds to every 32 milliseconds, which, in turn, activates the respective LED string.

The lighting device within the lighting system may emit a first color as one of a red colored light, a blue colored light, or green colored light. The second color may be one of a red colored light, a blue colored light, or green colored light that is not emitted by the first string of LEDs.

The ratio of active time between the first string of LEDs and the second string of LEDs may be a ratio of 1:1 or may be a ratio of 2:1. Furthermore, the ratio of activation between the first string of LEDs and the second string of LEDs may be any combination capable of producing a perceivable color from the spectrum of combinatory colors ranging between the color emitted by the first string of LEDs and the color emitted by the second string of LEDs.

The lighting device may be configured to maintain a consistent emission of colored light designated by one of the color emitted by the first string of LEDs, the color emitted by the second string of LEDs, or a color from the spectrum of combinatory colors ranging between the color emitted by the first string of LEDs and the color emitted by the second string of LEDs.

The control unit may include a dimmer, a luminosity indicator, a color synthesizer, a color indicator, a driver circuit, and a power supply. The dimmer may be configured to control the amount of voltage delivered to a first wire and a second wire. The luminosity indicator may be configured to display the luminosity of a lighting device electrically coupled to the first wire and second wire. The color indicator may be configured to display one of an emitted color and a perceived emitted color of the lighting device. The color synthesizer may include a switch configured to alternate a frequency of forwardly biased current between the first wire and the second wire. Additionally, the wire that receives forwardly biased current may be designated active when the respective string of LEDs to emit light is operable.

The lighting device may include a plurality of lighting devices within a lighting system. The driver circuit and power supply may be configured to drive the plurality of lighting devices.

The control unit may be managed by at least one of a remote control and a computerized device. The control unit may also include an electrical outlet adapter configured to receive a plurality of electrical plugs from lighting devices and manage the emitted color and luminosity thereof. The color synthesizer may be configured to alternate a designated active wire between the first wire and second wire within the range from every 16 milliseconds to every 32 milliseconds.

Another embodiment of the present invention is directed to a luminaire. The luminaire may include a bulb defined by an optical chamber and an Edison base. It may also include an LED board within the optical chamber comprising a first string of LEDs and a second string of LEDs. The first string of LEDs and the second string of LEDs may be configured to emit a differently colored light. The first string of LEDs may be oriented in an electrically opposite direction than the second string of LEDs. The luminaire may be configured to maintain a consistent emission of colored light designated by one of the color emitted by the first string of LEDs, the color emitted by the second string of LEDs, or a perceived color from the spectrum of combinatory colors ranging between the color emitted by the first string of LEDs and the color emitted by the second string of LEDs.

The first string of LEDs may be configured to emit one of a red colored light, a blue colored light, and green colored light. Similarly, the second string of LEDs may be configured to emit one of a red colored light, a blue colored light, and green colored light that is not emitted by the first string of LEDs.

The first string of LEDs may be configured to emit light having a first color. The second string of LEDs may be configured to emit light having a second color. The first and second strings of LEDs may be alternately activated to emit light having a perceived third color. The perceived third color may be defined as a perceived combined light. The alternate activation of the first and second strings of LEDs is faster than can be detected by the human eye, and the perceived third color is different from the first color and the second color.

The luminaire may include a ratio of activation between the first string of LEDs and the second string of LEDs of 2:1. The luminaire may maintain a frequency of activation between the first string of LEDs and the second string of LEDs that includes a ratio capable of producing a perceivable color from the spectrum of combinatory colors ranging between the color emitted by the first string of LEDs and the color emitted by the second string of LEDs.

DETAILED DESCRIPTION OF THE INVENTION

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Those of ordinary skill in the art realize that the following descriptions of the embodiments of the present invention are illustrative and are not intended to be limiting in any way. Other embodiments of the present invention will readily suggest themselves to such skilled persons having the benefit of this disclosure. Like numbers refer to like elements throughout.

Although the following detailed description contains many specifics for the purposes of illustration, anyone of ordinary skill in the art will appreciate that many variations and alterations to the following details are within the scope of the invention. Accordingly, the following embodiments of the invention are set forth without any loss of generality to, and without imposing limitations upon, the claimed invention.

In this detailed description of the present invention, a person skilled in the art should note that directional terms, such as "above," "below," "upper," "lower," and other like terms are used for the convenience of the reader in reference to the drawings. Also, a person skilled in the art should notice this description may contain other terminology to convey position, orientation, and direction without departing from the principles of the present invention.

Furthermore, in this detailed description, a person skilled in the art should note that quantitative qualifying terms such as "generally," "substantially," "mostly," and other terms are used, in general, to mean that the referred to object, characteristic, or quality constitutes a majority of the subject of the reference. The meaning of any of these terms is dependent upon the context within which it is used, and the meaning may be expressly modified.

Figure 1:
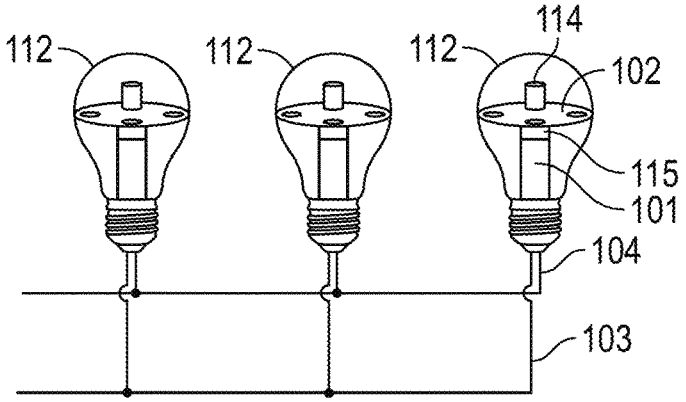
FIG. 1 (Prior Art)
FIG. 1 illustrates a connected lighting system as found in the prior art.
Figure 2:
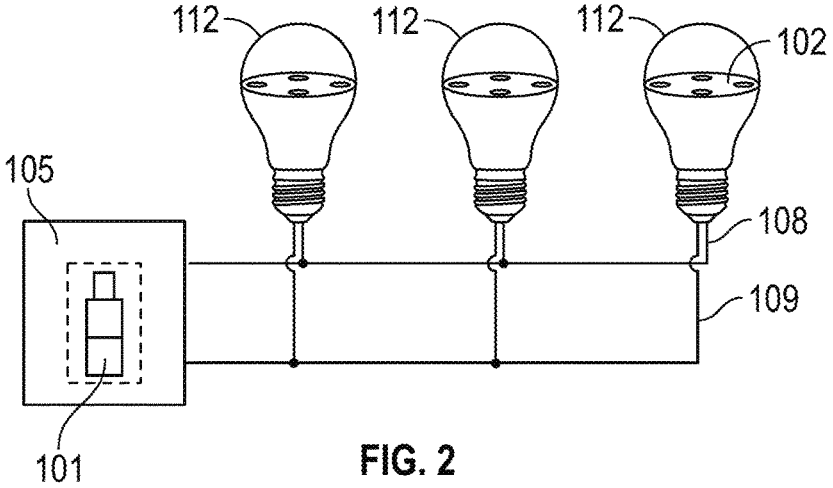
FIG. 2 illustrates a system for optimizing power and control found in standard connected lighting according to an embodiment of the present invention.

Referring to FIGS. 2, 3, 4*a* and 4*b*, the present invention will now be discussed. The present invention utilizes a control unit 105 to obviate the power supply 101, antenna 114, and radio 115 of the prior art illustrated in FIG. 1. Therefore, each individual bulb 112 only contains an LED board 102 encased therein, and in some embodiments, minimal control circuitry to operate the LED board 102 managed by a control unit 105. By consolidating the antenna 114, radio 115, and power supply 101 within a single control unit 105, a user is only required to replace the individual component or control unit 105 upon its respective failure. This is opposed to replacing each individual bulb 112 each time an individual component within the bulb 112 fails as well as reduces the cost of each individual bulb 112.

Figure 3:
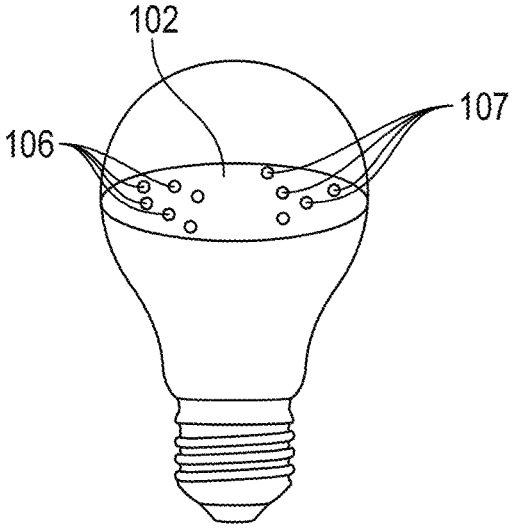
FIG. 3 is a cross-sectioned view of the interior of a bulb containing separate LED strings according to an embodiment of the present invention.

Additionally, the present invention utilizes an LED board 102 comprising at least two different LED strings. By way of non-limiting example, FIG. 3 depicts a bulb with two strings of LEDs. As shown in FIG. 3, the LED board 102 comprises a first string 106 of LEDs operable to emit light having a first spectral power distribution, corresponding to a first color or correlated color temperature (CCT). Furthermore, the LED board 102 comprises a second string 107 of LEDs operable to emit light having a second spectral power distribution, corresponding to a second color or CCT. The first spectral power distribution may be different from the second spectral power distribution, and the first color or CCT may be different from the second color or CCT. The first string 106 may be oriented in an electrically opposite direction than the second string 107, such that the forward direction for each of the strings is opposite to the other. Accordingly, whether the first or second string 106, 107 emits light may be determined by the direction of current within the circuit.

Referring additionally to FIG. 4, the control unit 105 determines which string is the active line 103. Moreover, the control unit 105 may act as a switch to determine which wire receives enough voltage to activate the respective string of LEDs. Accordingly, the first string of LEDs 106 and the second string of LEDs 107 may be alternately activated to emit light having a perceived third color. The perceived third color 120 may be defined as a perceived combined light. The alternate activation of the first and second strings of LEDs 106, 107 is faster than can be detected by the human eye. The perceived third color 120 is different than the first color and the second color.

Figure 4A:
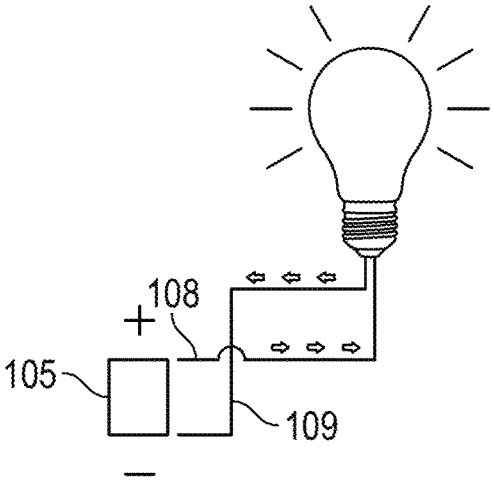
FIGS. 4*a-b* show directional currents utilized in the system illustrated in FIG. 2.

In FIG. 4*a* the control unit 105 delivers forward biasing current to a first wire 108 in order to operate the first string 106 of LEDs depicted in FIG. 3. In this embodiment the first string 106 LED diodes are oriented so that the first wire 108 allows forward biasing current to flow into the p-side, or anode, and through to the n-side, or cathode, thereby making the first wire 108 the active wire and the second wire 109 the neutral wire. This causes the first string 106 of LEDs within each of the individual LED bulbs 112 to emit light with the first string 106 colored light.

Figure 4B:
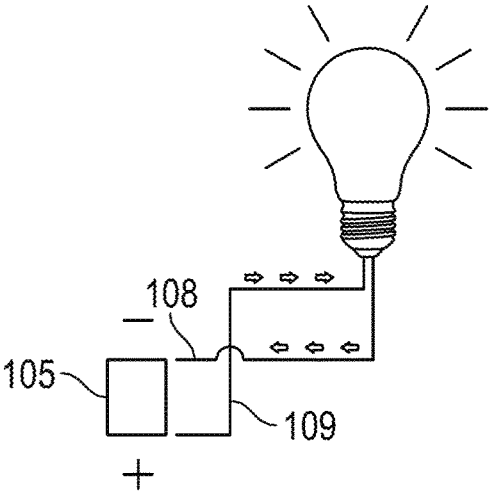

Additionally, should a user desire a differently colored light than the first string 106, the user may switch the control unit 105 to the mode of operation demonstrated by FIG. 4*b*. This mode of operation enables a second wire 109 to receive forward biasing current and thereby activate the second string 107 LEDs. In this embodiment the second string 107 LED diodes are oriented so that the second wire 109 allows forward biasing current to flow into the p-side, or anode, and through to the n-side, or cathode, thereby making the second wire 109 the active wire and the first wire 108 the neutral wire. This causes the LEDs within the individual LED bulbs 112 to emit second string 107 colored light.

By switching the active line between the first wire 108 and the second wire 109, a user is able to change or alternate the emitted light color within the same connected lighting system without replacing individual bulbs 112 to do so. It also obviates the need to purchase traditional color-changing bulbs that typically require use of a computerized device to communicate with the bulb or manipulation of an output selector on the bulb itself.

Figure 5:
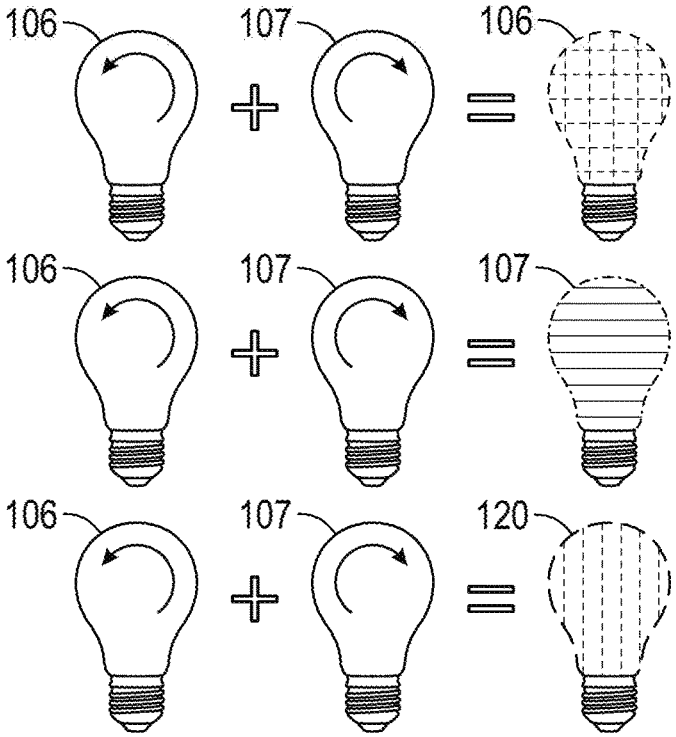
FIG. 5 is a demonstrative view according to the present invention of operation of the bulb illustrated in FIG. 3.
Figure 6:
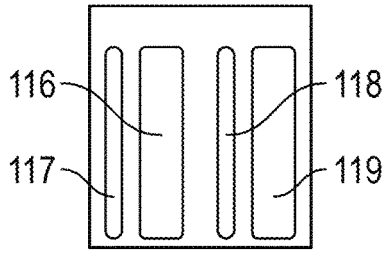
FIG. 6 shows an embodiment of a control unit utilized in the system illustrated in FIG. 2.

Referring now additionally to FIGS. 5 and 6, another function of the present invention may include creating the perception of combined color 120 when the emitted colors of the first string 106 and the second string 107 are repeatedly alternated by the control unit 105 faster than the human eye can detect. This may optimally be achieved at rate within a range of 60 Hz to 480 Hz. Alternatively, the control unit 105 may be operable to alternate the designated active wire between the first wire 108 and the second wire 109 within a range from every 16 milliseconds to every 32 milliseconds. By way of non-limiting example, a first string color 106 may be red and a second string color 107 may be green within the same bulb. By alternating 16 milliseconds of green emitted light with 16 milliseconds of red emitted light, a human observer would perceive the light being emitted from a single bulb as yellow. Furthermore, by changing the ratio of how often the emitted colors are alternated, differently perceived colors may be achieved. Again, by way of non-limiting example, if the alternating ratio between red and green is changed from 1:1 to 2:1 respectively, the light emitted by the bulb may be perceived as orange. In this example, the red colored string would be emitted for 32 milliseconds while the green colored string would be emitted for 16 milliseconds. Conversely, if the ratio of red to green colored light emission was 1:2, meaning 16 milliseconds of red alternated with 32 milliseconds of green, the light emitted by the bulb may be perceived as blue.

The control unit 105 may include a dimmer 116, a luminosity indicator 117, a color synthesizer 118, and a color indicator 119. The control unit 105 may also include a driver circuit and a power supply 101. The dimmer 116 may be adjusted by a user to control the amount of voltage delivered to the respective LED string within its threshold operating voltage range, i.e., the amount of voltage delivered to each of the first wire 108 and the second wire 109. The luminosity indicator 117 may be a series of indicating lights located on the control unit 105 that indicate the brightness of either an individual LED string or all connected bulbs within a connected lighting system. More particularly, the luminosity indicator 117 may be configured to display luminosity of the lighting device electrically coupled to the first wire 108 and the second wire 109.

The color indicator 119 may be configured to display one of emitted color and the perceived emitted color of the lighting device. The color synthesizer 118 located on the control unit 105 may operate to combine the colors within the individual bulbs 112. In one embodiment the color synthesizer 119 may represent the first string 106 at a first end and a second string 107 at a second end. The distance between the first and second end may represent the spectrum of colors between the first string 106 and second string 107. In some embodiments, the ends may represent different points along the Planckian locus. By manipulating the color synthesizer between the first and second end, a user may manipulate the amount of emitted colored light of each LED string and therefore control the overall combined color of the emitted light. Likewise, the color indicator 118 may be a series of indicating lights representing the spectrum of colors between the first string 106 and the second string 107 at a respective first and second end. When the color synthesizer is positioned to emit a certain colored light at or between the first string 106 and second string 107, the color indicator 118 may display the color indicating the user's selection. In one embodiment, the color synthesizer 118 may include a switch configured to alternate the frequency of forwardly biased current between the first wire 108 and the second wire 109. The wire that receives forward bias current is designated active when a respective string of LEDs is operable.

Figure 7:
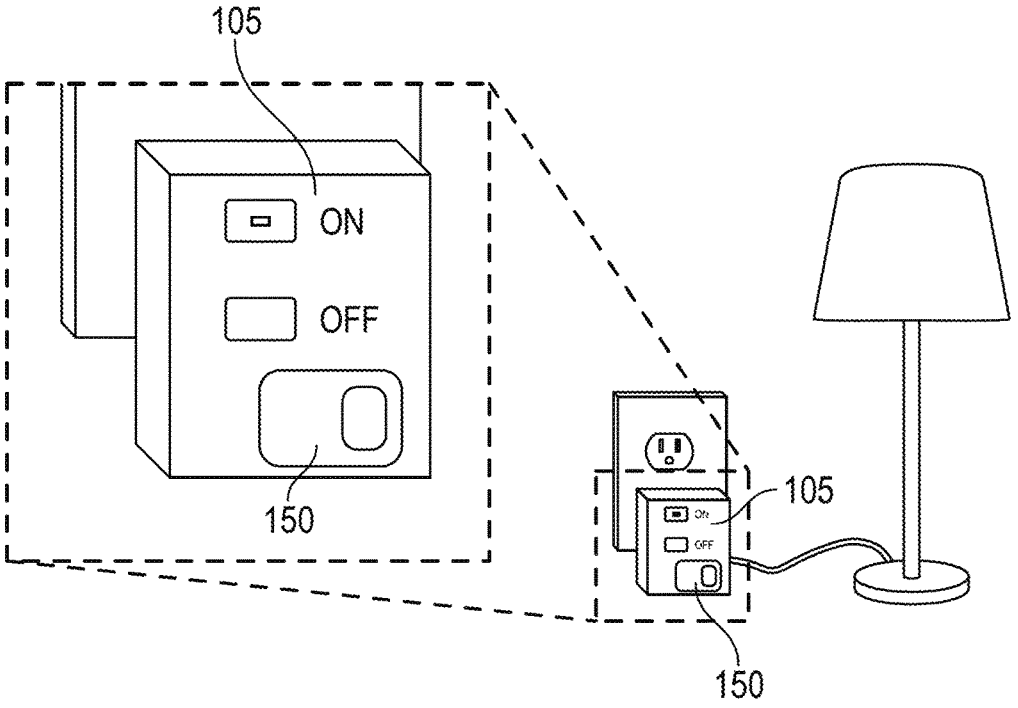
FIG. 7 shows alternative embodiments of the system illustrated in FIG. 2.

In another embodiment, the lighting device may include a plurality of lighting devices within the lighting system. The driver circuit and the power supply 101 may be configured to drive the plurality of lighting devices 112. Referring now to FIG. 7, another embodiment of the present invention may include the control unit 105 being managed remotely via smart phone or other mobile device. The control unit 105 may be managed by at least one of a remote control or a computerized device. More specifically, the control unit may be managed remotely by Bluetooth Low Energy controls 150 for easy and efficient management. In this embodiment a user may be able to manipulate the luminosity and color of the emitted bulbs 112 without physically touching the control unit 105. Another embodiment includes adapting the control unit 105 to a standard outlet whereby a standard lamp may be managed similarly.

Yet another embodiment may include the control unit 105 including a timer. In this embodiment, the color synthesizer 119 may be managed by pre-set user instructions. Further, the timer may be configured to communicate a time of day to the color synthesizer 119. The color synthesizer 119 may then activate a particular color within the lighting system based on the time of day. By way of non-limiting example, a user may desire a light emission with a higher color temperature during the morning hours of the day and a light emission with a lower color temperature during the evening hours. In this example a user would set the timer to communicate to the color synthesizer to activate the desired color in the morning then communicate to the color synthesizer to change the color in the evening. In another non-limiting example, a user may set the timer to a specific range of time whereby the emitted color would gradually shift from a starting color to an ending color based on a user input range of time and color.

Some of the illustrative aspects of the present invention may be advantageous in solving the problems herein described and other problems not discussed which are discoverable by a skilled artisan.

While the above description contains much specificity, these should not be construed as limitations on the scope of any embodiment, but as exemplifications of the presented embodiments thereof. Many other ramifications and variations are possible within the teachings of the various embodiments. While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

Thus the scope of the invention should be determined by the appended claims and their legal equivalents, and not by the examples given.

That which is claimed is:

1. A lighting system comprising:

a control unit comprising a color indicator; and a lighting device comprising an LED board within an optical chamber comprising a first string of LEDs, and a second string of LEDs, wherein each of the control unit and the LED board are configured to electrically couple to first and second wires;

wherein the first string of LEDs and the second string of LEDs are configured to emit light having different spectral power distributions within the visible spectrum, defining a first color and a second color, respectively;

wherein the first string of LEDs is oriented in an electrically opposite direction than the second string of LEDs;

wherein the control unit comprises a switch configured to direct current between the first wire and second wire;

wherein the first and second strings of LEDs are configured to be alternately activated to emit light having a perceived third color defined as a perceived emitted color;

wherein the color indicator is configured to display one of an emitted color and a perceived emitted color of the lighting device;

wherein the wire to which current is directed is designated active; and wherein the designated active wire activates one of the first string of LEDs and the second string of LEDs.

2. The system according to claim 1 wherein the control unit comprises a timer configured to communicate a time of day; and wherein the first color, the second color, or the third perceived color is changed based on the time of day.

3. The system according to claim 1 wherein the control unit is operable to alternate the designated active wire between the first wire and the second wire within a range from every 16 milliseconds to every 32 milliseconds thereby activating the respective LED string.

4. The system according to claim 1 wherein the first color is one of a red colored light, a blue colored light, and green colored light; and wherein the second color is one of a red colored light, a blue colored light, and green colored light that is not emitted by the first string of LEDs.

5. The system according to claim 4 wherein the lighting device is configured to maintain a consistent emission of colored light designated by one of:

the color emitted by the first string of LEDs;

the color emitted by the second string of LEDs; and a color from the spectrum of combinatory colors ranging between the color emitted by the first string of LEDs and the color emitted by the second string of LEDs.

6. The system according to claim 1 wherein a ratio of active time between the first string of LEDs and the second string of LEDs is a ratio of 1:1.

7. The system according to claim 1 wherein a ratio of active time between the first string of LEDs and the second string of LEDs is a ratio of 2:1.

8. The system according to claim 1 wherein a ratio of activation between the first string of LEDs and the second string of LEDs includes a ratio capable of producing a perceivable color from the spectrum of combinatory colors ranging between the color emitted by the first string of LEDs and the color emitted by the second string of LEDs.

9. A control unit comprising:

a dimmer;

a luminosity indicator;

a color synthesizer;

a color indicator;

a driver circuit; and a power supply;

wherein the dimmer is configured to control the amount of voltage delivered to a first wire and a second wire;

wherein the luminosity indicator is configured to display luminosity of a lighting device electrically coupled to the first wire and second wire;

wherein the color indicator is configured to display one of an emitted color and a perceived emitted color of the lighting device;

wherein the color synthesizer includes a switch configured to alternate a frequency of forwardly biased current between the first wire and the second wire; and wherein the wire that receives forwardly biased current is designated active when a respective string of LEDs is operable.

10. The control unit according to claim 9 further comprising a timer configured to communicate a time of day; and wherein one of the emitted color and perceived emitted color is changed based on the time of day.

11. The control unit according to claim 9 wherein the lighting device comprises a plurality of lighting devices within a lighting system; and wherein the driver circuit and power supply are configured to drive the plurality of lighting devices.

12. The control unit according to claim 9 wherein the control unit is managed by at least one of a remote control and a computerized device.

13. The control unit according to claim 9 further comprising an electrical outlet adapter configured to receive a plurality of electrical plugs from lighting devices and manage the emitted color and luminosity thereof.

14. The control unit according to claim 9 wherein the color synthesizer is configured to alternate a designated active wire between the first wire and second wire within the range from every 16 milliseconds to every 32 milliseconds.

15. A luminaire comprising:

a bulb defined by an optical chamber and an Edison base;

a control unit comprising a color indicator and a color synthesizer; and an LED board within the optical chamber comprising:

a first string of LEDs, and a second string of LEDs;

wherein the first string of LEDs and the second string of LEDs are configured to emit a differently colored light;

wherein the first string of LEDs is oriented in an electrically opposite direction than the second string of LEDs;

wherein the color indicator is configured to display one of an emitted color and a perceived emitted color of the lighting device;

wherein the color synthesizer includes a switch configured to alternate a frequency of forwardly biased current between the first wire and the second wire;

wherein the luminaire is configured to maintain a consistent emission of colored light designated by one of:

the color emitted by the first string of LEDs;

the color emitted by the second string of LEDs; and a perceived color from the spectrum of combinatory colors ranging from the color emitted by the first string of LEDs and the color emitted by the second string of LEDs.

16. The luminaire according to claim 15 wherein the first string of LEDs is configured to emit one of a red colored light, a blue colored light, and green colored light, and the second string of LEDs is configured to emit one of a red colored light, a blue colored light, and green colored light not emitted by the first string of LEDs.

17. The luminaire according to claim 16 wherein the frequency of activation between the first string of LEDs and the second string of LEDs includes a ratio capable of producing a perceivable color from the spectrum of combinatory colors ranging between the color emitted by the first string of LEDs and the color emitted by the second string of LEDs.

18. The luminaire according to claim 15 wherein the ratio of activation between the first string of LEDs and the second string of LEDs is 2:1.

* * * * *